US006655977B2

(12) United States Patent
Ives et al.

(10) Patent No.: US 6,655,977 B2
(45) Date of Patent: Dec. 2, 2003

(54) METHOD AND APPARATUS FOR ELECTRICALLY CONNECTING TWO OBJECTS

(75) Inventors: Thomas W Ives, Boise, ID (US); Darrel Poulter, Middleton, ID (US); Holger A. Petersen, III, Nampa, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/105,143

(22) Filed: Mar. 25, 2002

(65) Prior Publication Data

US 2002/0098741 A1 Jul. 25, 2002

Related U.S. Application Data

(62) Division of application No. 09/687,365, filed on Oct. 13, 2002.

(51) Int. Cl.[7] ..... H01R 4/50
(52) U.S. Cl. ..... 439/342; 439/265
(58) Field of Search ..... 439/342, 343, 439/345, 346, 347, 370, 372, 341, 157, 261–265, 259, 260

(56) References Cited

U.S. PATENT DOCUMENTS 2,654,872 A * 10/1953 Saul et al. ..... 439/263
5,232,375 A * 8/1993 Todd ..... 439/157
5,310,358 A * 5/1994 Johnson et al. ..... 439/358

* cited by examiner

*Primary Examiner*—Ross Gushi

(57) ABSTRACT

An apparatus for electrically connecting two objects together includes a first object which has a first connective surface defined thereon, and a plurality of first electrical pads supported on the first connective surface. A second object has a second connective surface defined thereon which supports a plurality of second electrical pads configured to contact the first electrical pads. The first and second objects are configured to be electrically connected to each other by movement of the first object relative to the second object in a given direction and along a continuous path of movement which is substantially parallel to the first connective surface. The apparatus further includes an alignment member which is movably supported on the second object and which is configured to engage the second object when moved so as to substantially align the first electrical pads with the second electrical pads in order to facilitate contact there between.

2 Claims, 8 Drawing Sheets

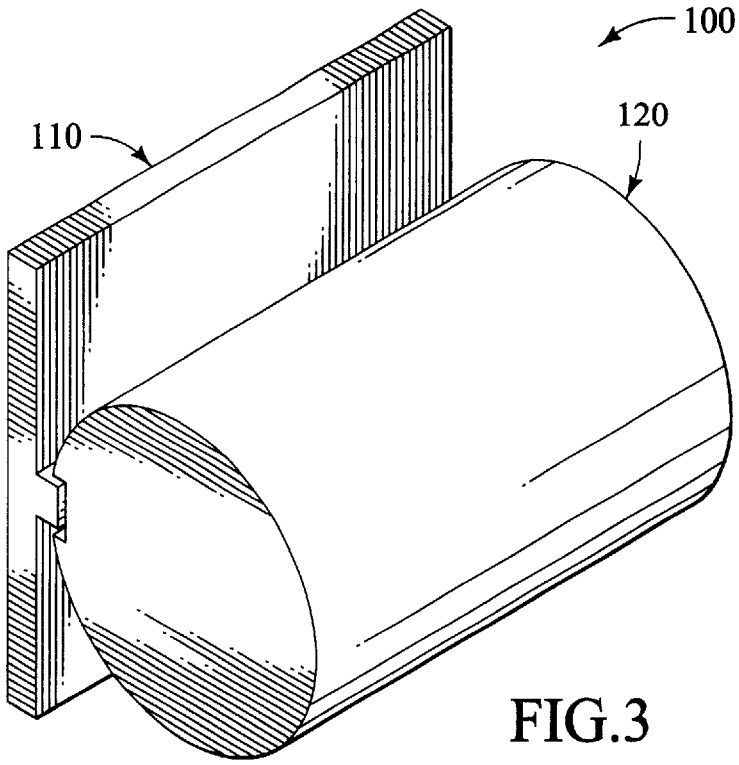
FIG.3
FIG.4
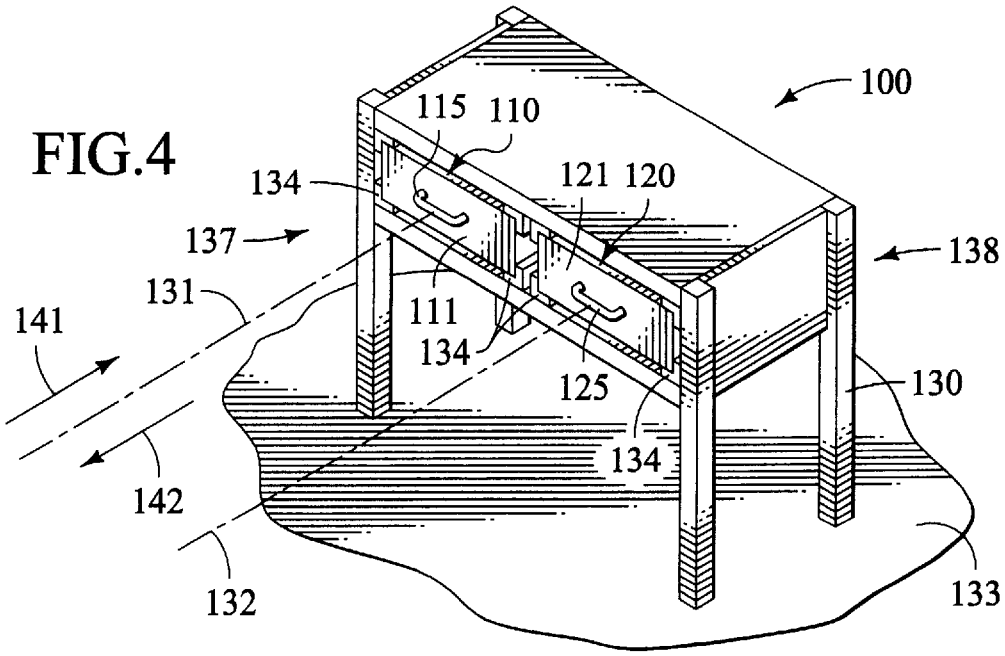

FIG.5
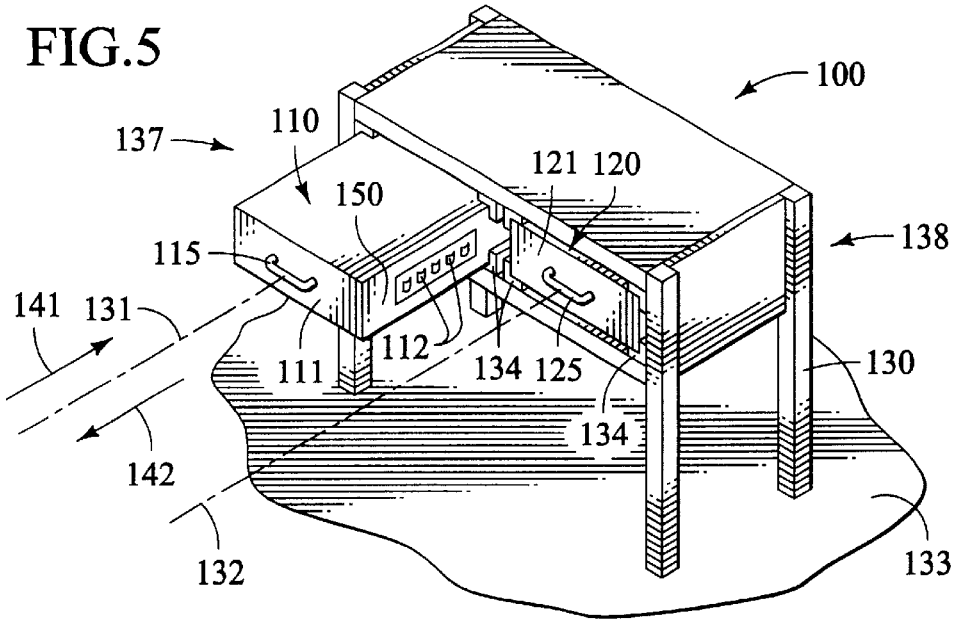
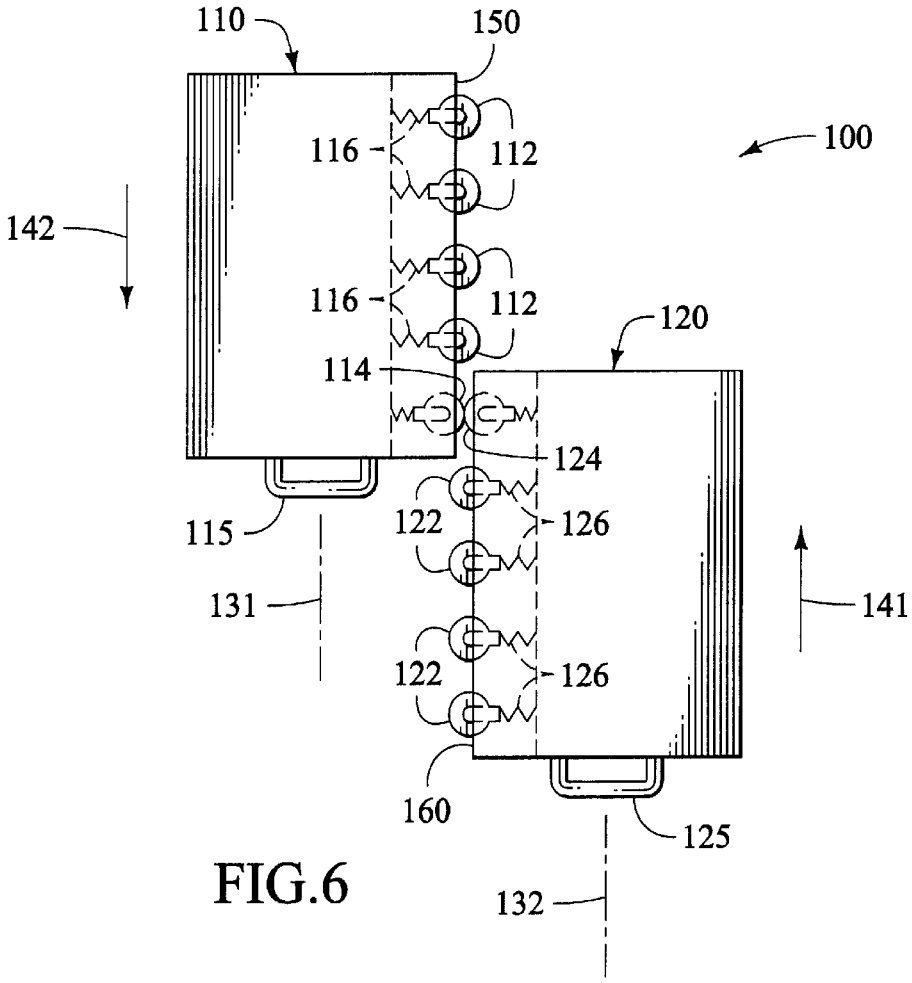
FIG.6

METHOD AND APPARATUS FOR ELECTRICALLY CONNECTING TWO OBJECTS

CROSS REFERENCE TO RELATED APPLICATIONS

This is a divisional of copending application Ser. No. 09/687,365 filed on Oct. 13, 2002 which is hereby incorporated by reference herein.

FIELD OF THE INVENTION

This invention pertains to methods and apparatus for electrically connecting one object with another.

BACKGROUND OF THE INVENTION

This invention pertains to methods and apparatus for electrically connecting two or more electronic or electrical components together for the passing of electrical signals or power there between. One type of application in which the invention can be used is that of electronic devices such as, but not limited to, digital equipment and the like. A specific example of digital equipment in which the invention can be used is that of computers, and related equipment. The invention can be used in digital equipment to electrically connect various components which make up the equipment. These components include, but are not limited to, disk drives, printed circuit boards (PCA's), and power sources, etc.

Generally, prior art electrical and electronic equipment, including digital equipment, is made up of various electrical components which are electrically connected together. Generally, electrical signals and power are passed between the components. Usually, the components are supported on some type of support structure such as a rack. Occasionally, any one of the components will need to be removed from the rack and replaced with another component. In order to facilitate the removal and replacement of the various components of the equipment, electrical connectors are generally used to electrically connect the components to one another. The term "electrical connector" generally refers to a type of electrical coupling which can be coupled and uncoupled relatively easily and conveniently without special tools or procedures. Usually, an electrical connector will include at least two portions which are configured to matingly engage each other to form an electrical connection between both portions. One portion of the connector is typically permanently supported on a first component while a mating portion of the connector is permanently supported on a second component which is to be electrically connected to the first component. As mentioned above, one important function of an electrical connector is to facilitate the convenient removal and replacement of various electrical and electronic components which are electrically connected to one another. To this end, electrical connectors are typically produced in one of many standardized configurations so that any one of a number of different electrical components may be replaced with another electrical component with relative ease.

Typical prior art electrical connectors are configured in what can be described as a "plug and socket" configuration. In this configuration, one portion of the electrical connector is configured as a male plug and the mating portion of the electrical connector is configured as a female socket. Typically, each portion of a plug and socket electrical connector is made up of a body, or some type of suitable support, with a plurality of connector pads supported thereon. Referring to FIG. 1, a typical prior art plug and socket type of electrical connector is shown. As shown in FIG. 1, a male plug portion 10 is rigidly supported on a first component 20. Likewise, a female socket portion 11 is rigidly supported on a second component 21, and is configured to be electrically connected with the male portion 10.

As can seen from FIG. 1, connector pads 12 are supported on the male plug portion 10. Likewise, connector pads 13 are supported on the female socket portion 11. As is evident from FIG. 1, the connector pads 12 of the male portion 11 are configured to contact the connector pads 13 of the female portion 11. Also, the connector portions 10, 11 are configured such that the connector pads 12, 13 do not come into contact with one another until after the male plug portion 10 has been inserted into the female socket portion 11. This configuration helps ensure proper alignment of the connector pads 12 with the connector pads 13 when the first and second components 20, 21 are electrically connected.

As shown in FIG. 1, either connector portion 10, 11 follows a substantially straight path of movement, represented by the line marked 17, when the connector portions 10, 11 are brought together to be connected. In order to properly connect the male portion 10 to the female portion 11, the first electrical component 20 should be moved along the path of movement 17 toward the second electrical component 21 in the direction represented by the arrow marked 18. Alternatively, the second electrical component 21 could be moved along the path of movement 17 toward the first electrical component 20 in the direction marked 19, which is substantially opposite the direction 18. Likewise, to disconnect the first component 20 from the second component 21, the first component 20 should be moved along the path of movement 17 away from the second component 21 in the direction represented by the arrow marked 19. In the alternative, the first and second components 20, 21 could be disconnected by moving the second component along the path of movement 17 away from the first component 20 in the direction 18. It should be noted that the path of movement 17 passes through both connector portions 10, 11.

Now referring to FIG. 2, a side elevation view of a prior art assembly of electrical components 20, 21 is shown. As can be seen, each of several first electrical components 20 are shown to be connected to one of several second electrical components 21 by respective electrical connector portions 10, 11. As further shown in FIG. 2, each electrical component 20, 21 is supported in respective fixed positions on a rack 25. Supporting the components 20, 21 in this manner on the rack 25 allows each first electrical component 20 to be connected to, and disconnected from, the respective second electrical component 21 by a single movement along the respective path 17. Likewise, each second component 21 can be installed and removed from its respective fixed position on the rack 25 in the same manner. This configuration is advantageous because it allows the electrical components 20, 21 to be placed adjacent to one another in close proximity as shown in FIG. 3. This facilitates relatively efficient use of space and materials.

As is further evident from a study of FIG. 2, the rack 25 has a first side 26 and an opposite second side 27. Each first electrical component 20 is supported on the first side 26 of the rack 25 and each second component 21 is supported on the second side 27 of the rack 25. Further study of FIG. 2 will show that, in order to remove either of the electrical components 20, 21 from the rack 25, access must be available to each respective side 26, 27 of the rack 25. For example, in order to remove one of the first electrical components 20 from the rack 25, access must be available on the first side 26 of the rack 25. The access on the first side 26 of the rack 25 must be sufficient to allow removal of the first component 20 from the rack 25 along the respective path of movement 17 in the direction 19. Similarly, in order to remove one of the second electrical components 21 from the rack 25, access must be available on the second side 27 of the rack 25. The access on the second side 27 of the rack 25 must be sufficient to allow removal of the second component 11 from the rack 25 along the path of movement 17 in the direction 18.

Oftentimes, electrical components 20, 21 must be housed in specially-outfitted rooms with precisely controlled atmospheric conditions. Generally, available floor space in these rooms for additional racks 25 and components 20, 21 is severely limited. Thus, racks 25 and components 20, 21 such as that shown in FIG. 2 are often placed side-by-side in rows. However, because access is needed to both sides thereof as explained above, the rows of racks 25 cannot be placed against a wall or other obstruction.

Additionally, in order to work on interrelated components 20, 21 which are on opposite sides of the row of racks 25, maintenance personnel must often walk around long rows of racks.

What is needed then is an apparatus for connecting two components and which allows more efficient positioning of the components and which allows more convenient access to each component for removal and replacement thereof.

SUMMARY OF THE INVENTION

In accordance with one embodiment thereof, the invention includes a first object and a second object which are configured to be electrically connected to one another. The first object has a first connective surface which has a plurality of first electrical pads supported thereon. The second object has a second connective surface which has a plurality of second pads supported thereon. The first pads are configured to electrically contact the second pads so as to electrically connect the first and second objects. The first and second objects are configured to be electrically connected and subsequently disconnected by movement of the first object relative to the second object along a continuous path of movement in a single direction.

In accordance with another embodiment thereof, the invention includes an alignment member which can be movably supported on either object and which is configured to move so as to cause selective contact between the first and second electrical pads when the first and second objects are adjacent one another. The member can also be movably supported on one object and configured so as to engage the other object in order to align the first and second pads so as to facilitate contact there between. The member can be further configured to lock the first and second objects together.

In accordance with a further embodiment, the invention includes a method of electrically connecting the first object with the second object.

BRIEF DESCRIPTION OF THE DRAWINGS

FIG. 3 is a perspective view of the an apparatus in accordance with one embodiment of the present invention showing alternative shapes of the first and second objects.

FIG. 4 is a perspective view of an apparatus in accordance with another embodiment of the present invention.

FIG. 5 is a perspective view of the apparatus depicted in FIG. 4, with the first object pulled away from the first position.

FIG. 6 is a perspective view of the first object which is shown in the apparatus depicted in FIG. 4.

DETAILED DESCRIPTION OF THE INVENTION

Figure 1:
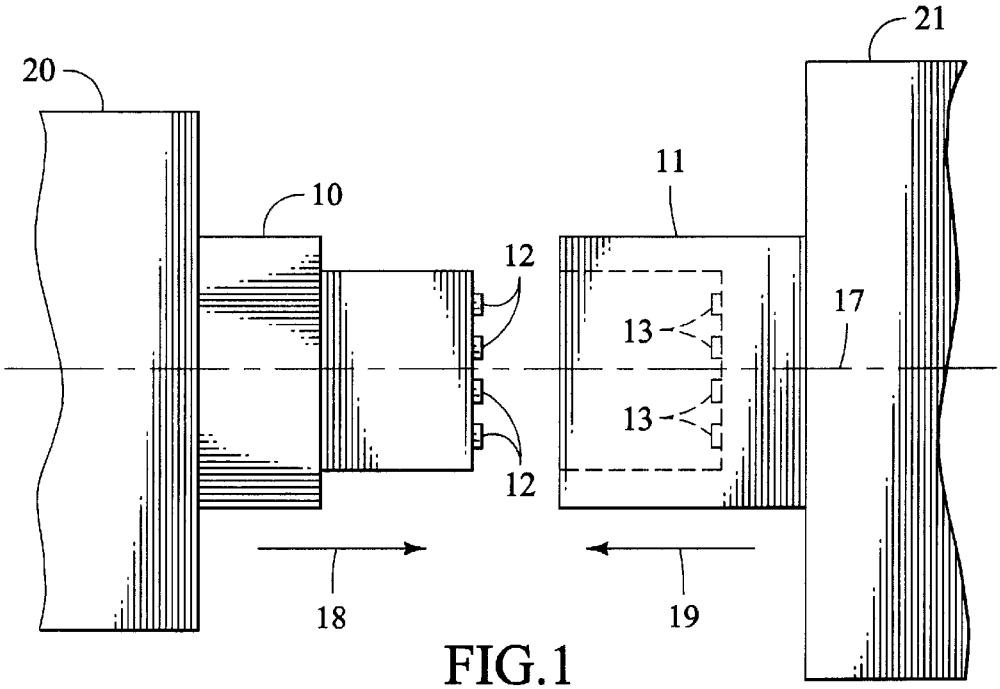
FIG.1 PRIOR ART
FIG. 1 is a side elevation view of a prior art apparatus with a prior art electrical connector.
Figure 2:
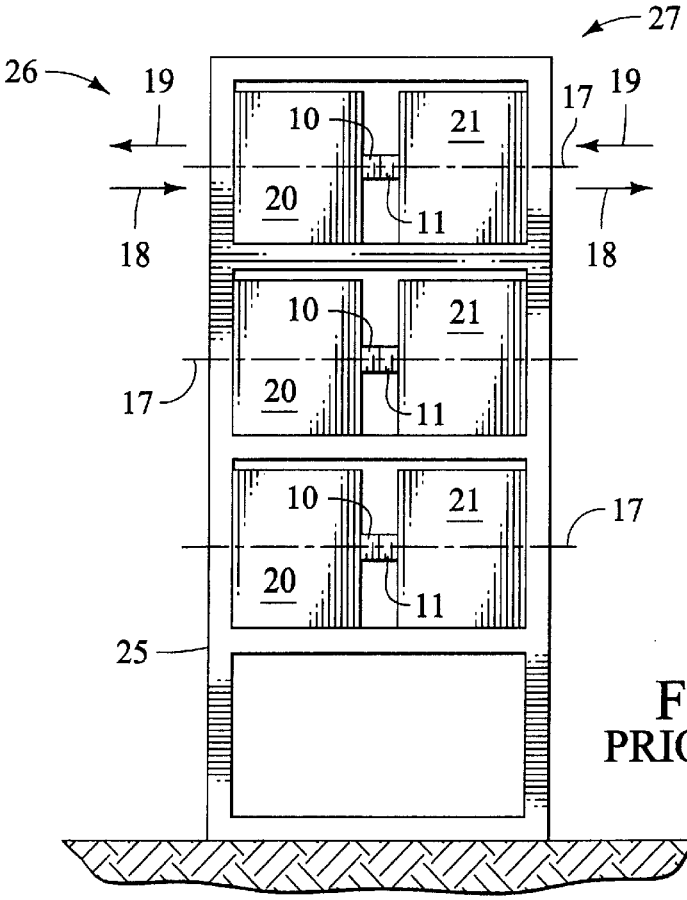
FIG.2 PRIOR ART
FIG. 2 is a side elevation view of several prior art electrical connectors in a typical application.

The invention includes method and apparatus for electrically connecting two objects. The two objects can be two different electrical components of an electrical device. The method and device is for an apparatus which provides for either object to be installed on, or removed from, a respective supported position on a rack or other suitable support. The objects can be supported adjacent to one another in electrical contact, and can be individually moved into, or out of, such electrical contact, along parallel paths of movement. The method and apparatus includes a plurality of first electrical pads supported on a first object which are configured to contact a plurality of second electrical pads supported on a second object. The method and apparatus can also include an alignment member movably supported on either of the objects and configured to cause contact of the first pads with the second pads. The member can also be configured to align the objects to facilitate contact between the pads, and can also be configured to lock the two objects together.

Referring to FIG. 4, an apparatus 100 for electrically connecting two objects is shown in accordance with one embodiment thereof. The apparatus 100 includes a first object 110 and a second object 120. The objects 110, 120 can be any one of a number of possible devices which utilize an electrical connection between them. For example, the objects 110, 120 can be electrical components such as printed circuit assemblies, disk drives, and power sources, etc. As further shown in FIG. 4, the first object 110 has a front side 111. Similarly, the second object 120 has a front side 121. Handles 115, 125 can be mounted on the front sides 111, 121 of the first and second objects 110, 120 respectively, to facilitate handling thereof. A rack 130 is also shown in FIG. 4. The rack 130 has a front side 137 which is generally open and an opposite back side 138 which can be closed or otherwise obstructed from access thereto. Alternatively, the back side 138 can be substantially open. The rack 130 supports the first and second objects 110, 120 in the first and second positions as shown in FIG. 4. The rack 130 generally rests on a floor 133 or the like.

The first object 110 can be selectively supported in a first position on the rack 130 as shown in FIG. 4 so as to be electrically connected to the second object 120. The second object 120 can likewise be selectively supported in a second position on the rack 130 as shown in FIG. 4 so as to be electrically connected to the first object 110. By "selectively supported," we mean that the first and second objects 110, 120 can be individually placed into the rack 130, or other suitable support, for electrical connection to one another, and individually removed therefrom for disconnection. By "first position," we mean the position of the first object 110 when it has been placed fully in the rack 130, or other suitable support, and is being supported thereby as shown in FIG. 4. By "second position," we mean the position of the second object 120 when it has been placed fully in the rack 130, or other suitable support, and is being supported thereby as shown in FIG. 4. It is noted that the front 111 of the first object 110 can be substantially parallel to, and face the same direction as, the front 121 of the second object 120 as shown in FIG. 4. Also, the front sides 111, 121 of the first and second objects 110, 120 can be generally aligned with the front side 131 of the rack 130.

Now moving to FIG. 5, a perspective view of the apparatus 100 is shown with the second object 120 supported in the second position and the first object 110 pulled away from the first position. A study of FIG. 5 will reveal that the first object 110 is configured to be placed into the first position by movement thereof along a first path 131 in a first direction 141 while the second object 120 is supported in the second position. Conversely, the first object 110 can be removed from the first position by movement thereof along the first path 131 in a second direction 142, which is opposite the first direction 141, while the second object 120 is supported in the second position. It is evident from FIG. 5 that the first path 131 can be substantially continuous. By "continuous," we mean substantially linear, with no breaks or angles therein.

Still referring to FIG. 5, it can be seen that the first object 110 has a first connective surface 150 defined thereon. As shown in FIG. 5, the first connective surface 150 can be substantially flat. However, it is understood that the first connective surface 150 can be configured so as to have other shapes which are not shown. Furthermore, FIG. 5 shows a plurality of first electrical pads 112 that are supported on the first connective surface 150. The first electrical pads 112 can be made of electrically conductive material such as, for example, copper or the like. It is evident also, from FIG. 5, that the first electrical pads 112 can be aligned on the first object 110 so as to be substantially parallel to the first connective surface 150. It is also be evident from a study of FIG. 4 as well as FIG. 5 that, when the first object 110 is moved from its position shown in FIG. 5 and into the rack 130 to be supported in the first position as shown in FIG. 4, the first pads 112 can be aligned so as to be substantially parallel to the first path 131. Furthermore, it is also evident that the first connective surface 150 can be substantially parallel to the first path 131.

Figure 7:
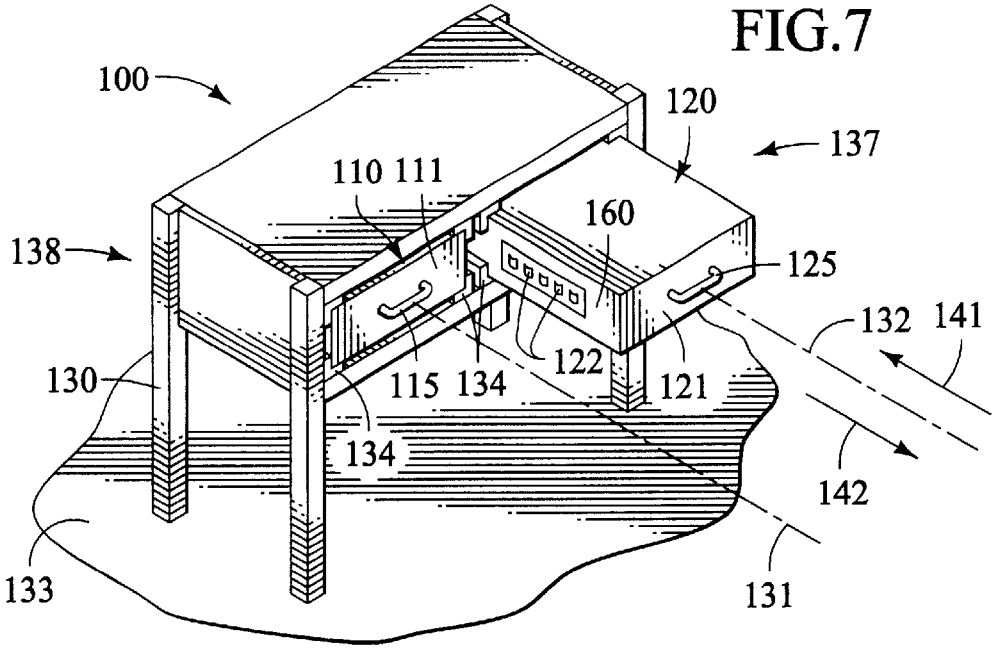
FIG. 7 is a perspective view of the apparatus depicted in FIG. 4, with the second object pulled away from the second position.

Now moving to FIG. 7, a perspective view of the apparatus 100 is shown with the first object 110 supported in the first position and the second object 120 pulled away from the second position. A study of FIG. 7 will reveal that the second object 120 can be configured to be placed into the second position by movement thereof along the second path 132 in the first direction 141 while the first object is supported in the first position. And, conversely, the second object 120 can be configured to be removed from the second position by movement along a second path 132 in the second direction 142 while the first object 110 is supported in the first position. It should be evident from FIGS. 5 and 7 that the first and second paths 131, 132 can be substantially parallel to one another. It is noted that, when both objects 110, 120 are in the respective first and second positions, the first path 131 intersects the first object 110 but does not intersect the second object 120. Also, the second path 132 intersects the second object 120 but does not intersect the first object 110. It should be evident from FIG. 7 that the second path 132 is continuous.

Still referring to FIG. 7, it can be seen that the second object 120 has a second connective surface 160 defined thereon. As shown in FIG. 7, the second connective surface 160 can be substantially flat. However, it is understood that the second connective surface 160 can be alternatively configured so as to have other shapes which are not shown. Furthermore, FIG. 7 shows a plurality of second electrical pads 122 that are supported on the second connective surface 160. The second electrical pads 122 can be made of electrically conductive material such as, for example, copper or the like. It should be evident also, from FIG. 7, that the second electrical pads 122 can be aligned on the second object 120 so as to be substantially parallel to the second connective surface 160. It is also evident from a study of FIG. 4 as well as FIG. 7 that, when the second object 120 is moved from its position shown in FIG. 7 and into the rack 130 to be supported in the second position as shown in FIG. 4, the second pads 122 can be substantially aligned with the second path 132. Furthermore, it is evident that the second connective surface 160 is substantially parallel to the second path 132.

As can be seen in FIGS. 4, 5, and 7, the rack 130 also can have guides 134 which are configured to guide the first and second objects 110, 120 into and out of the rack 130 along the first and second paths of movement 131, 132 respectively. The guides 134 can also serve to provide a given alignment of the first and second objects 110, 120 relative to one another while they are supported on the rack 130 in the first and second positions, respectively.

As is seen from an examination of FIGS. 4, 5, and 7, the first and second connective surfaces 150, 160 can be substantially parallel with, and in juxtaposed relation to, one another when the first and second objects 110, 120 are supported on the rack 130 in the first and second positions, respectively. This facilitates contact between the first pads 112 and the second pads 122 when the first and second objects 110, 120 are supported in the first and second positions, respectively as shown in FIG. 4. By "contact," we mean electrical contact between the first and second pads 112, 122 such that electrical current can flow from each of the first pads 112 to a corresponding second w pad 122, or vice versa.

It is seen also from a study of FIGS. 5, and 7 that the first pads 112 and the second pads 122 can be arranged so as to have a given pattern, and can also be arranged so as to have a substantially constant given interval between each individual first pad 112, and between each individual second pad 122 respectively. In other words, the first pads 112 can be arranged with a given spacing between each first pad 112, and the second pads 122 can be arranged with the same given spacing between each second pad 122. This arrangement allows each first pad 112 to contact a corresponding second pad 122 when the first and second objects 110, 120 are in the first and second positions respectively as shown in FIG. 4. However, in order to ensure that any given first pad 112 contacts the proper corresponding second pad 122, the first and second objects 110, 120 should preferably be in proper alignment with respect to one another when each is supported on the rack 130. In other words, the first object 110 is preferably in its proper position along the first path 131 with respect to the second object 120 as shown in FIG. 4 in order to facilitate proper alignment of the first and second pads 112, 122. Alternatively, the second object is preferably in its proper position along the second path 132 with respect to the first object 110 as shown in FIG. 4 in order to facilitate proper alignment of the first and second pads 112, 122.

It is also understood that, although the first and second objects 110, 120 are otherwise depicted herein to be configured as "rectangular boxes," each object 110, 120 can be configured in any shape which allows the first electrical pads 112 to be presented to the second electrical pads 122 such that contact between the first and second pads 112, 122 can be accomplished by the manner described herein. FIG. 3 is a perspective view of the first and second objects 110, 120 in accordance with an alternative embodiment of the present invention, in which the first and second objects have alternative shapes. As shown in FIG. 3, the first object 110 can be configured as a substantially flat plate, for example. Also, for example, the second object 120 can be configured as a substantially round cylinder as shown in FIG. 3.

Additionally, as shown in FIGS. 5 and 7, the first and second electrical pads 112, 122 are depicted herein to be substantially linearly aligned. Further, the pads 112, 122 are depicted to be substantially linearly aligned with the paths 131, 141 of the objects 110, 120. It is understood, however, that the electrical pads 112, 122 can be arranged in any orientation on the objects 110, 120 which allows the first electrical pads 112 to be presented to the second electrical pads 122 so as to facilitate electrical contact there between. For example, the first and second electrical pads 112, 122 can be arranged on the first and second objects 110, 120, respectively, in rows (not shown) which are perpendicular to the paths 131, 141. Alternatively, the electrical pads 112, 122 can be arranged on the objects 110, 120 in two-dimensional patterns (not shown) or three-dimensional patterns (not shown), rather than linearly aligned as shown.

Now referring to FIG. 6, a top view of both the first and second objects 110, 120 is shown. It is evident from FIG. 6 that the first and second pads 112, 122 can be configured as substantially cylindrical rollers that are resiliently supported on the first and second objects 110, 120, respectively. It is also evident from FIG. 6 that each first and second pad 112, 122 can be resiliently biased by way of a resilient member such as, for example, a first and second spring 116, 126, respectively. Each first and second pad 112, 122 can be configured so as to partly protrude from each respective first and second connective surface 150, 160. In other words, each first and second pad 112, 122 can be configured as, for example, a spring-loaded roller that protrudes from each respective connective surface 150, 160, and which can be resiliently deflected inward toward each respective connective surface 150, 160.

As further shown in FIG. 6, as the second object 120 moves relative to the first object 110 along the second path 132 in the first direction 141, a first roller 114 can contact a second roller 124. This can cause each of the first and second rollers 114, 124 to be pushed, or resiliently deflected, inward as shown in FIG. 6. This, in turn, can cause the first and second rollers 114, 124 to push against each other to facilitate electrical contact there between. It is evident from FIG. 6 that contact between the first and second rollers 114, 124 can be caused by movement of the first object 110, relative to the second object 120, along the first path 131 in the second direction 142.

Figure 8:
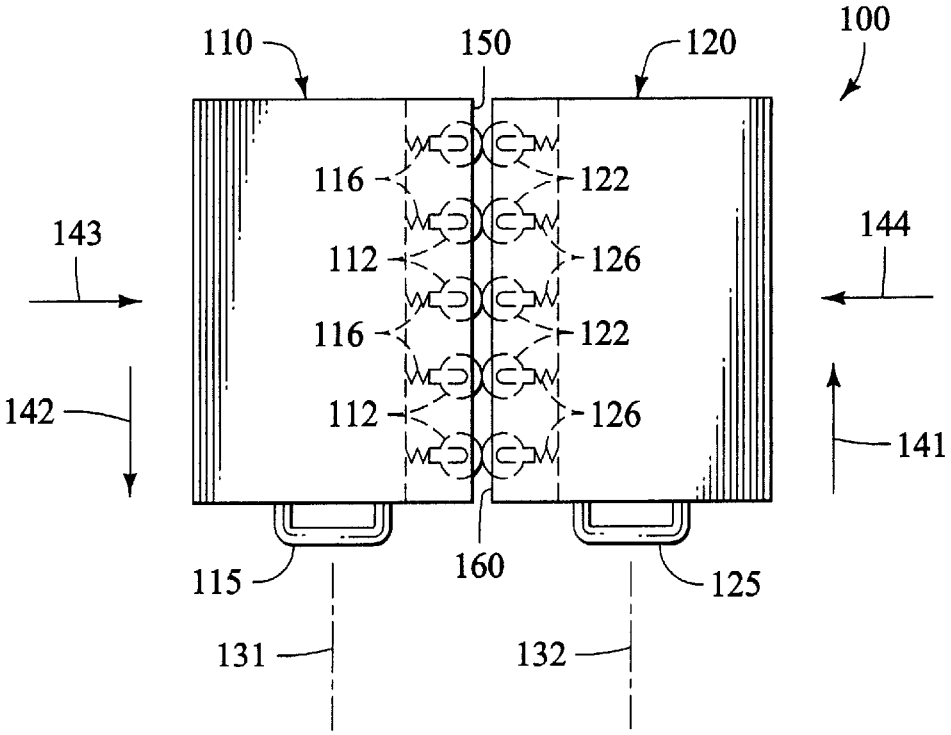
FIG. 8 is a perspective view of the second object which is shown in the apparatus depicted in FIG. 4.

Now moving to FIG. 8, another top view of the first and second objects 110, 120 is shown. It is evident from FIG. 8 that the second object 120 can be placed into a position relative to the first object 110 such that each of the second pads 122 is in contact with a corresponding first pad 112. It is also evident from FIG. 8 that each of the first and second pads 112, 122 can be configured to be pushed, or resiliently deflected, inward as shown. As is evident from FIG. 8, each of the first pads 112 can push against each of the second pads 122, which can result in resilient deflection of each of the first and second pads. However, from FIGS. 6 and 8, it is evident that the first and second pads 112, 122 need not be configured as rollers as shown. That is, in an alternative configuration which is not shown, only the first pads 112 can be configured as rollers, for example, and the second pads 122 can be configured to be substantially flat.

A further study of FIG. 8 reveals that the relative positions of the first and second objects 110, 120 as shown, can alternatively be achieved by movement of the second object 120 relative to the first object 110 along the second path 132 in either the first direction 141, or the second direction 142. As a further alternative, the relative positions of the first and second objects 110, 120 as shown, can be achieved by movement of the first object 110 relative to the second object 120 along the first path 131 in the either the first direction 141, or the second direction 142.

It is also be evident from FIG. 8 that the relative positions of the first and second objects 110, 120 as shown can be achieved by movement of the first object 110 in a third direction 143 which is substantially normal to the first path 131. Likewise, the relative positions of the first and second objects 110, 120 as shown can be achieved by movement of the second object 120 in a fourth direction 144 which is substantially normal to the second path 132. Also, as is evident, the relative positions of the first and second objects 110, 120 as shown can be achieved by movement of the first object relative to the second object in any direction which is between the second direction 142 and the third direction 143, or which is between the first direction 141 and the third direction. Similarly, the relative positions of the first and second objects 110, 120 as shown can be achieved by movement of the second object relative to the first object in any direction which is between the first direction 141 and the fourth direction 144, or which is between the second direction 142 and the fourth direction. However, movement of the first and second objects 110, 120 in any direction other than the first and second directions 141, 142, would require an alternative configuration (not shown) of the rack 130 which would allow such movement. That is, it is understood that the configuration of the rack 130 shown in FIGS. 4, 5 and 7 allows movement of the first and second objects 110, 120 in the first and second directions 141, 142 only.

Still referring to FIG. 8, it can be seen that the second object 120 can be removed from its position as shown, by movement thereof along the second path 132 in either the first direction 141 or the second direction 142. Similarly, the first object 110 can be removed from its position as shown by movement thereof along the first path 131 in either the first direction 141 or the second direction 142. In addition, the second object 120 can be removed from its position as shown by movement thereof in the third direction 143 relative to the first object, or in other directions as described above. And, likewise, the first object 110 can be removed from its position as shown by movement thereof in the fourth direction 144 relative to the second object 120, or in other directions as described above. Thus, it is evident from FIGS. 6 and 8 that the first and second objects 110, 120 can be electrically connected to one another by movement of the second object relative to the first object in any of a number of directions, including the first, second, and third 141, 142, 143, until the first and second pads 112, 122 are in contact with one another as shown in FIG. 8. Similarly, the first and second objects 110, 120 can be electrically connected to one another by movement of the second object relative to the first object in any of a number of directions, including the first, second, or fourth 141, 142, 144, until the first and second pads 112, 122 are in contact with one another as shown in FIG. 8. Conversely, the first and second objects 110, 120 can be electrically disconnected from one another by movement of one object away from the other object in directions opposite to those discussed above for connecting the objects. We refer to this as a "multi-directional" feature of the apparatus 100.

Thus, it is evident that the first and second objects 110, 120 can be electrically connected and subsequently electrically disconnected by movement of the first object 110 relative to the second object 120 along a continuous path of movement, such as the first path 131, in a single direction, such as the first direction 141. Moreover, it should be evident that the continuous path of movement, such as the first path 131, can be substantially straight. Alternatively, the continuous path can be curvilinear.

Figure 9:
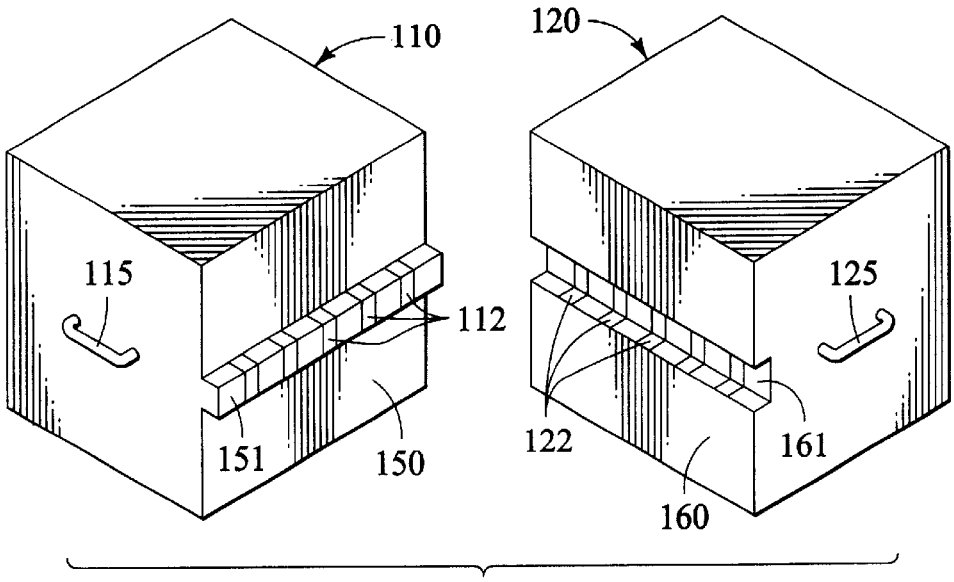
FIG. 9 is a perspective view of the apparatus in accordance with another embodiment of the invention showing the ridge and trough.

Moving now to FIG. 9, a perspective view is shown of the first and second objects 110, 120 in accordance with an alternative embodiment of the invention. As shown in FIG. 9, the first connective surface 150 can have a ridge 151 formed thereon. Also, as shown in FIG. 9, the second connective surface 160 can have a substantially open-ended trough, or channel, 161 formed thereon, and which is configured for mating engagement with the ridge 151. As further shown in FIG. 9, the first pads 112 can be supported on the ridge 151, and the second pads, 122 can be supported within the trough 161.

Figure 10:
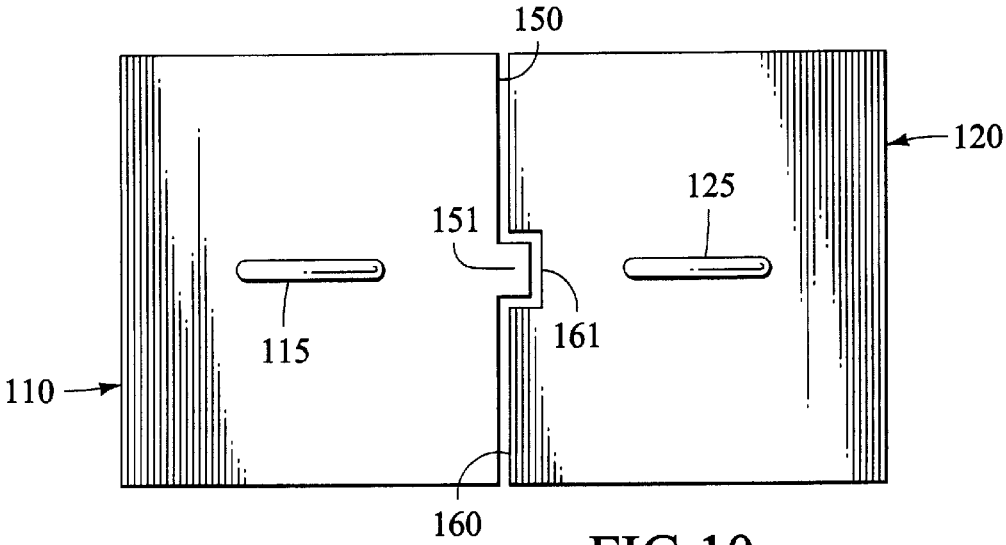
FIG. 10 is a front elevation view of the apparatus depicted in FIG. 9.

Referring to FIG. 10, a front elevation view is shown of the first and second objects 110, 120 which are depicted in FIG. 9. Now referring to FIGS. 9 and 10, it can be seen that the ridge 151 and trough 161 are configured so as to matingly engage one another when the first connective surface 150 is placed adjacent to the second connective surface 160 as shown. By "matingly engage," we mean that the ridge 151 and trough 161 fit together so as to substantially guide the first and second pads 112, 122 into position to facilitate electrical connection thereof. It is understood that, although the ridge 151 is shown as having a substantially rectangular cross-section, it can alternatively be configured to have one of a number of different possible cross-sections. For example, in accordance with an alternative embodiment which is not shown, the ridge 151 can be configured to have a substantially "U"-shaped cross-section. In accordance with another alternative embodiment which is not shown, the ridge 151 can have a substantially "V"-shaped cross-section. Likewise, although the trough 161 is shown as having a substantially rectangular cross-section, it can also be configured in accordance with the alternative embodiments discussed above, to have one of a number of different possible cross-sections and so as to matingly engage with the ridge 151 as generally shown in FIG. 10. For example, in accordance with the alternative embodiments discussed above for the ridge 151, which are not shown, the trough 161 can be configured to have a substantially "U"-shaped cross-section, or a substantially "V"-shaped cross-section.

Figure 11:
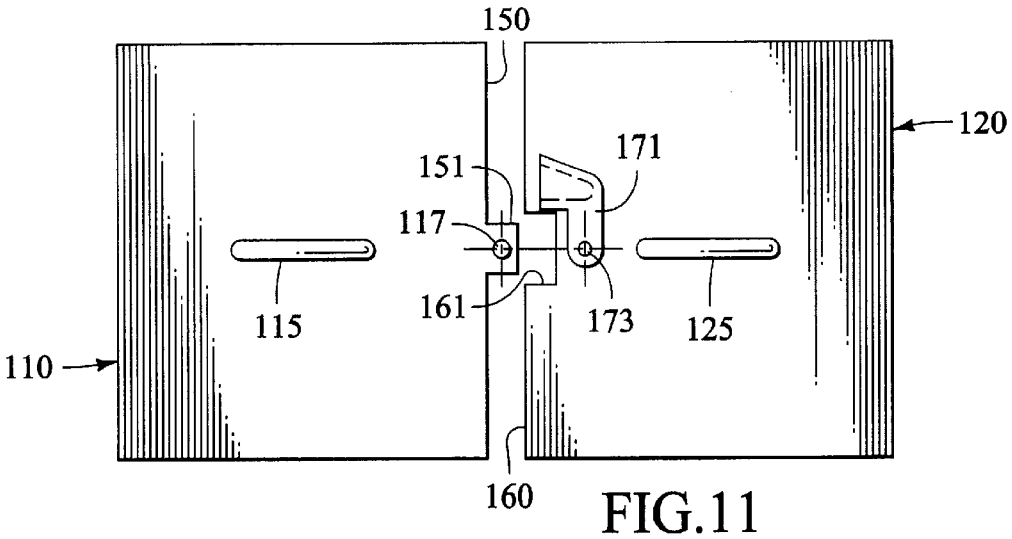
FIG. 11 is a front elevation view of the apparatus in accordance with further embodiment of the invention showing the alignment member.

Referring to FIG. 11, a front elevation view is shown of the apparatus 100 in accordance with another alternative embodiment of the present invention. The apparatus 100 as shown in FIG. 11 includes the first connective surface 150 which is defined on the first object 110. As is seen, the first connective surface 150 can form a substantially rectangularly shaped ridge 151. It is understood that, as mentioned above, the first connective surface 150 needs not be limited to any particular shape. Further reference to FIG. 11 reveals the second object 120 which includes the second connective surface 160 which is defined thereon. The second connective surface 160 can form a substantially rectangularly shaped trough, or channel, 161 which is configured to matingly engage the ridge 151 formed on the first connective surface 150. It is understood that, as mentioned above, the second connective surface 160 needs not be limited to any particular shape, although it is preferable that the shape of the first and second connective surfaces 150, 160 are substantially complimentary as generally depicted herein.

Figure 14:
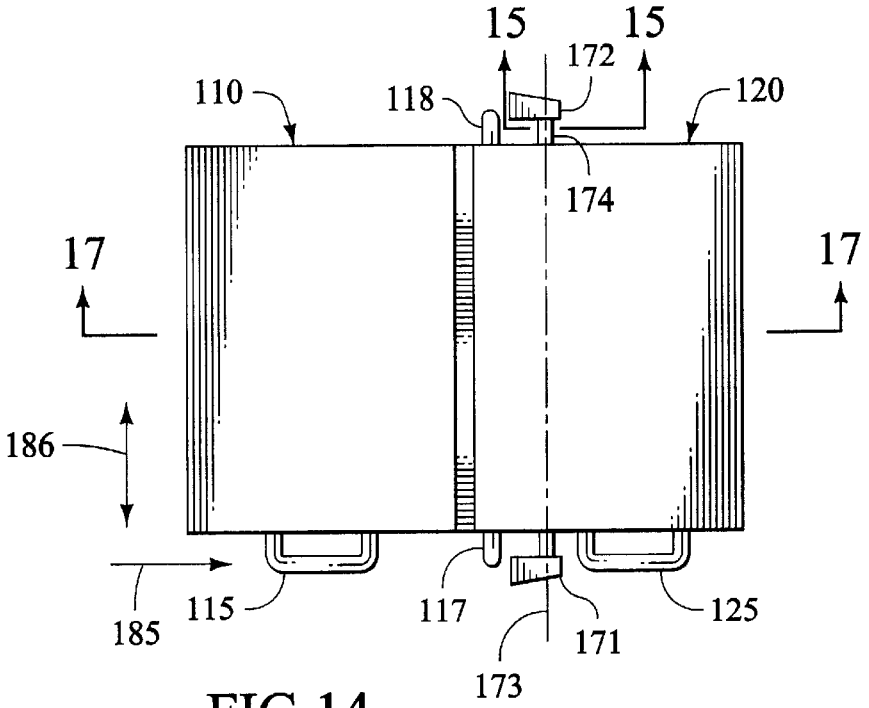
FIG. 14 is a top view of the apparatus depicted in FIG. 11.

Now moving to FIG. 14, a top plan view is shown of the apparatus 100 which is depicted in FIG. 11. Referring to FIGS. 11 and 14, the first object 110 can have a first protrusion 117 formed thereon. Preferably, the first object 110 can have, in addition to the first protrusion 117, a second protrusion 118 formed thereon such that the first and second protrusions 117, 118 are disposed on opposite sides of the first object 110, and substantially aligned, as shown. Also, the apparatus 100 can include a first alignment member 171 which is movably supported on the second object 120. A second alignment member 172 can also be movably supported on the second object 120. As shown, the first and second alignment members 171, 172 can be disposed on opposite sides of the second object 120, and can be configured to rotate about an axis of rotation 173.

As further shown, the first and second alignment members 171, 172 can be connected to a shaft 174 which can be configured to rotate about the axis of rotation 173. Each of the first and second alignment members 171, 172 can be rigidly connected to the shaft 174. In the alternative, each of the first and second alignment members 171, 172 can be independently rotatable with respect to the shaft 174, such that each of the alignment members and the shaft can be rotated individually. For example, the shaft 174 can be configured so as to rotate relative to the alignment members 171, 172, and can also be configured to protrude through one or both of the alignment members so that the shaft can be grasped and manually rotated independently of the alignment members.

Figure 15:
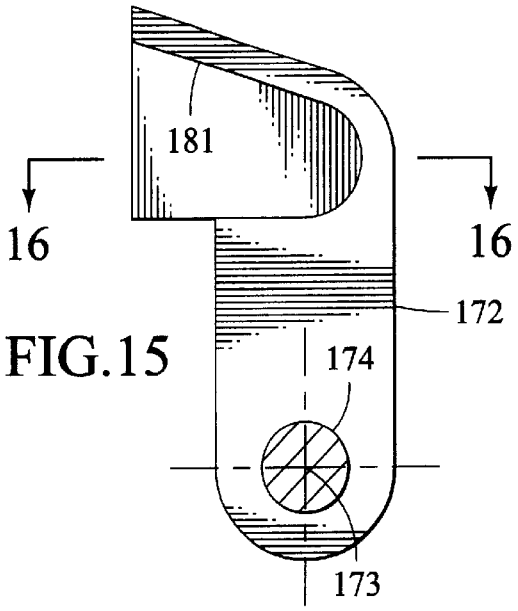
FIG. 15 is a sectional view of the second alignment member depicted in FIG. 14.
Figure 16:
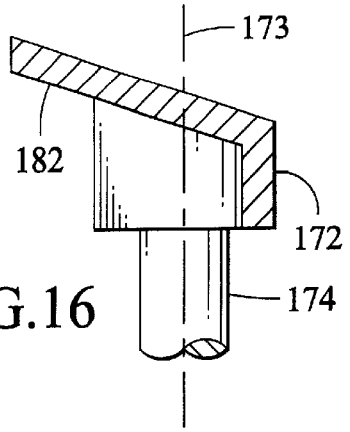
FIG. 16 is a sectional view of the second alignment member depicted in FIG. 15.

Now referring to FIGS. 15 and 16, a side elevation view of the second alignment member 172 is shown in FIG. 15, and a sectional view of the second alignment member is shown in FIG. 16. As is seen in FIG. 15, the second alignment member 172 can have a first cam surface 181 formed thereon. As is seen in FIG. 16, a second cam surface 182 can also be formed on the second alignment member 172. Preferably, first and second cam surfaces 181, 182 are also be formed on the first alignment member 171.

Figure 12:
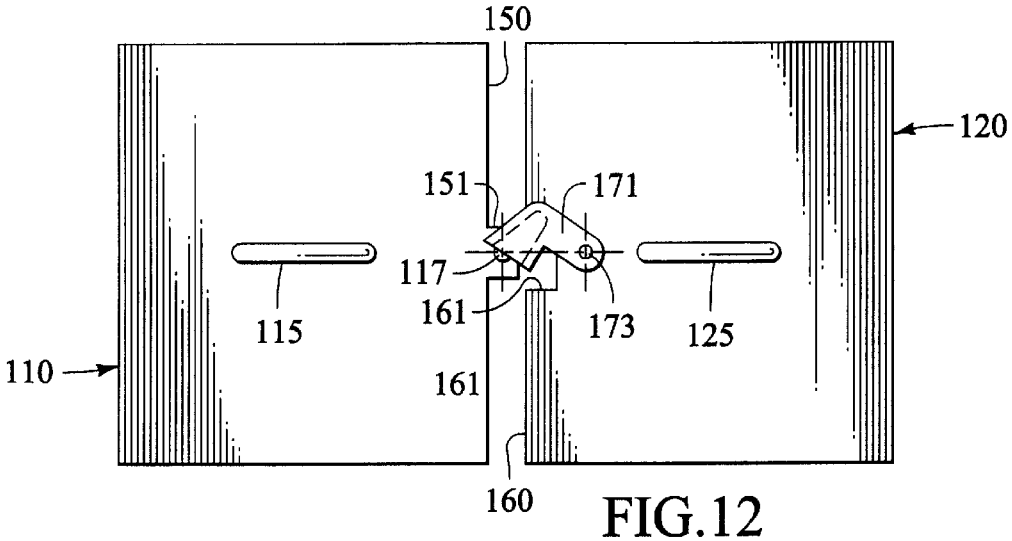
FIG. 12 is a front elevation view of the apparatus depicted in FIG. 11 showing the alignment member rotated approximately forty-five degrees from that shown in FIG. 11.
Figure 13:
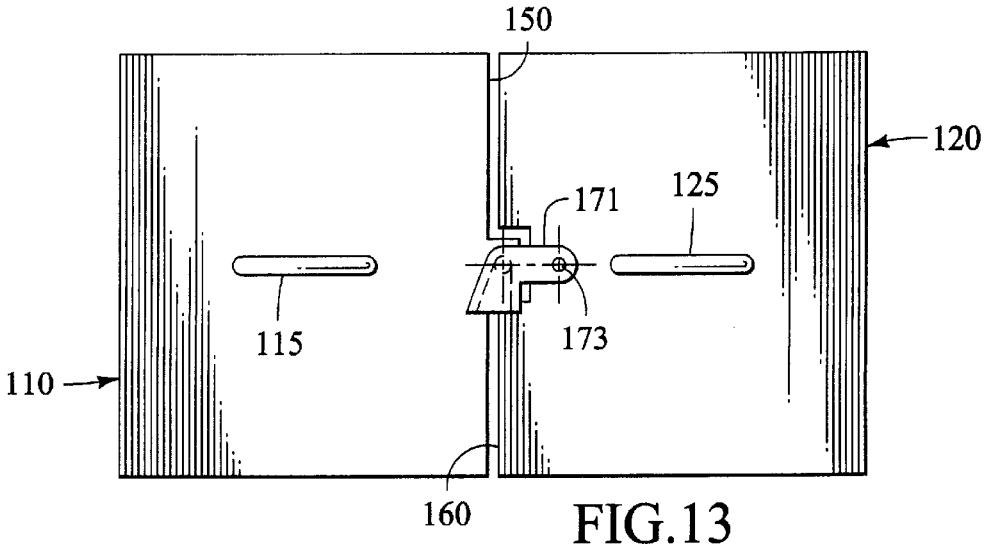
FIG. 13 is a front elevation view of the apparatus depicted in FIG. 11 showing the alignment member rotated approximately ninety degrees from that shown in FIG. 11.

Moving back to FIG. 12, another front elevation view is shown of the apparatus 100 which is depicted in FIG. 11. As is seen, the first alignment member 171 can be configured to move, or rotate about the axis 173, so as to engage the first protrusion 117 when the first and second objects 110, 120 are proximate one another as shown. In FIG. 13 another front elevation view is shown of the apparatus 100 which is depicted in FIG. 11. As is seen in FIG. 13, when the first alignment member 171 is fully engaged with the first protrusion 117, the first and second objects 110, 120 are substantially adjacent one another and substantially locked together. Now referring to FIGS. 14 and 15, it is evident that, when the first and second alignment members 171, 172 are moved into engagement with the first and second protrusions 117, 118, respectively, then the first cam surface 181, which is preferably formed on each of the alignment members 171, 172, contacts the respective protrusion 117, 118 so as to cause substantial alignment of the first object 110 in a lateral direction 185, relative to the second object 120 so as to substantially align the first and second pads 112, 122 with one another. Similarly, as is evident from FIGS. 14 through 16, when the first and second alignment members 171, 172 are moved into engagement with the first and second protrusions 117, 118, respectively, then the second cam surface 182, which is preferably formed on each of the alignment members 171, 172, contacts the respective protrusion 117, 118 so as to align the first object 110 in a fore and aft direction 186 with respect to the second object 120 so as to substantially align the first and second pads 112, 122 with one another. We refer to this as a "self-registration" feature of the apparatus 100.

Figure 17:
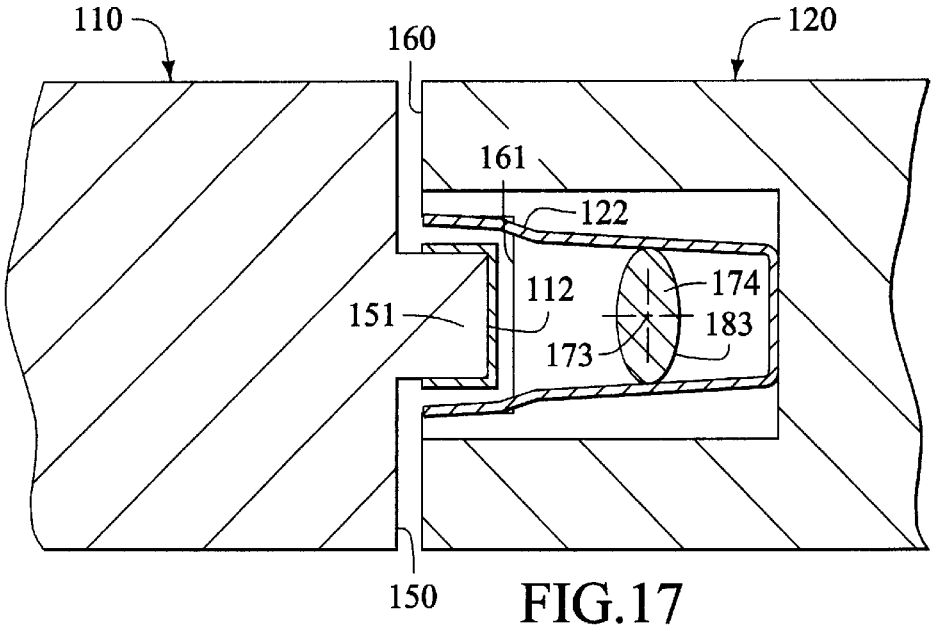
FIG. 17 is a sectional view of the apparatus depicted in FIG. 11.

Moving to FIG. 17, a cross-sectional view is shown of the apparatus 100 which is depicted in FIG. 14. As is seen in FIG. 17, the shaft 174 can be supported on the second object 120 and can be configured to rotate about the axis of rotation 173. As also seen, the shaft 174 can have a substantially oblong, or elliptical, cross-sectional shape so as to define a third cam surface 183 thereon. As further seen, the first pads 112 can be supported on the first connective surface 150 of the first object 110. Also, the second pads 122 can be supported on the second object 120, and can be configured to contact the third cam surface 183 as shown. The second pads 122 can also be configured so as to be resiliently flexible. It is noted that, as shown in FIG. 17, the second pads 122 can be configured to be resiliently biased so as to press against the third cam surface 183. The resilient bias of the second pads 122 can facilitate electrical contact between the first and second pads 112, 122. However, as shown in FIG. 17, the second pads 122 are being held away from the first pads 112 by the third cam surface 183.

Figure 18:
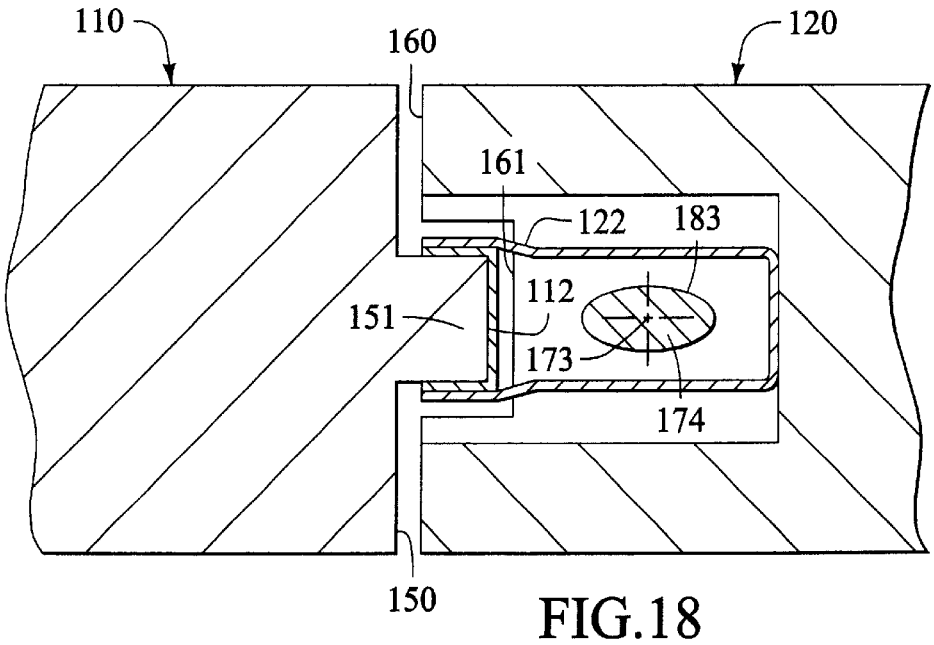
FIG. 18 is a sectional view of the apparatus depicted in FIG. 11 with the shaft rotated approximately ninety degrees from that shown in FIG. 18.

Now moving to FIG. 18, another cross-sectional view is shown of the apparatus 100 which is depicted in FIG. 14. From FIG. 18 it is seen that the shaft 174 has been rotated about the axis 173 approximately ninety degrees from its position shown in FIG. 17. It can also be seen from FIG. 18 that, due to the rotation of the shaft 174, the bias of the second pads 122, and the shape of the third cam surface 183, the second pads have moved into contact with the first pads 112. That is, the third cam surface 183 has rotated so as to allow the second pads 122 to resiliently deflect toward, and into contact with, the first pads 112. Conversely, if the shaft 174 is rotated back to its original position which is depicted in FIG. 17, then the third cam surface 183 can cause the second pads 122 to be resiliently deflected away from the first pads 112.

It is noted that, when the second pads 122 are deflected away from the first pads 112, the second pads can also be substantially flush, or below flush, with the second connective surface 160, as shown. In operation, the ridge 151 and trough 161 can be placed into engagement as shown in FIG. 17 while the second pads 122 are in a withdrawn position, or held open by the third cam surface 183. Then, the shaft 174, along with the third cam surface 183, can be rotated from the position shown in FIG. 17 to the position shown in FIG. 18 so that the second pads 122 come into contact with the first pads 112 while the ridge 151 is engaged with the trough 161. This allows the first and second objects 110, 120 to be placed into position adjacent to one another without with out requiring an extra force to overcome the resilient bias of the second pads. We refer to this as the "zero insertion force" feature of the apparatus 100.

In yet another embodiment of the present invention, the invention includes a method for electrically connecting two objects together. The method includes the step of providing a first object which has a first connective surface defined thereon and which also has a plurality of first electrical pads supported on the first connective surface. The method further includes providing a second object which has a second connective surface defined thereon and which also has a plurality of second electrical pads supported on the second connective surface. The method includes the additional step of moving the first object relative to the second object along a first path of movement which is substantially parallel to the first and second connective surfaces. The method can include the further step of stopping movement of the first object relative to the second object when the first electrical pads are substantially aligned with the second electrical pads.

The method can also include the steps of providing an alignment member which is movably supported on the second object. Moving the alignment member can cause more precise alignment of the first and second electrical pads. Another step can include moving the alignment member so as to substantially lock the first and second objects together. The method can also include placing the first object into a supported first position on a suitable support such as a rack or the like. The first object is placed into the first position by moving the first object along a first path of movement in a first direction. The method can also include the step of placing the second object into a second position substantially proximate the first object while the first object is supported in the first position. While in the second position, the second object is supported on a suitable support such as a rack or the like. The first and second objects can be supported on separate supports and preferably be supported on the same support. The second object is placed into the second position by moving the second object in the first direction along a second path of movement which is substantially parallel to the first path of movement. The first and second objects can be configured so that the step of placing the second object into the second position causes electrical connection between the first and second objects.

The method, can further include an additional step of providing the second object with an alignment member which can be configured to cause electrical connection between the first and second objects when moved and when the first and second objects are being supported in the first and second positions respectively. A further step is moving the alignment member to cause electrical connection between the first and second objects when they are each supported in the respective first and second positions. The alignment member can further be configured so as to cause alignment of the first and second objects when moved. Accordingly, the method can include the additional step of moving the alignment member so as to cause substantial alignment of the first and second objects when they are in the first and second positions, respectively. The alignment member can further be configured so as to lock the first and second objects together when moved. Thus, the method can include the further step of moving the alignment member so as to lock the first and second objects together when they are in the first and second positions, respectively.

The method can also include the additional step of electrically disconnecting the first and second objects by moving the first object along the first path of movement in a second direction which is substantially opposite the first direction. Alternatively, the method can include the additional step of electrically disconnecting the first and second objects by moving the second object along the second path of movement in the first direction.

Referring back to FIG. 4, the typical operation of the apparatus 100 shall be described. As is evident, the first object 110 can be configured to be electrically connected to the second object 120, and vice versa. The first object 110 can be placed into the rack 130 or other suitable support by movement thereof along a continuous first path of movement 131 in a first direction 141. The second object 120 can then be electrically connected to the first object by placing the second object into the rack 130 by movement thereof in the first direction 141 along a continuous second path of movement 132 which is substantially parallel to the first path of movement 131.

Moving to FIG. 5, the first object 110 can include a first connective surface 150 which is defined thereon and which can be configured so as to be substantially parallel to the first path of movement 131 as shown. The first object 110 can also include a plurality of first electrical pads 112 which are supported thereon and which can be supported on the first connective surface 150 as shown in FIG. 5. Similarly, as shown in FIG. 7, the second object 120 can include a second connective surface 160 which is defined thereon and which can be configured so as to be substantially parallel to the second path of movement 132 as shown. The second object 120 can also include a plurality of second electrical pads 122 which are supported thereon and which can be supported on the second connective surface 160 as shown in FIG. 7.

Referring now to FIGS. 6 and 8, the first and second pads 112, 122 can be configured to contact one another for electrical connection there between when the first and second objects 110, 120 are placed next to one another such that the first and second connective surfaces 150, 160 are in juxtaposed relation to one another as shown in FIG. 8. Returning briefly to FIG. 4, it is evident that by simply placing the first and second objects 110, 120 in the first and second positions as shown, an electrical connection can be made between the first pads 112 and the second pads 122.

Moving to FIGS. 9 and 10, the apparatus 100 in accordance with an alternative embodiment of the present invention can include a ridge 151 defined on the first connective surface 150, and can also include a substantially open-ended trough, or channel, 161 defined on the second connective surface 160. As further shown, the first pads 112 can be supported on the ridge 151, and the second pads 112 can be supported within the trough 161. The trough 161 and ridge 151 can be configured to matingly engage one another when the first and second connective surfaces are in juxtaposed relation to one another as shown in FIG. 10. It is further evident that, during the engagement of the trough 161 and ridge 151, the first and second pads 112, 122 can be placed in substantial alignment with one another. Thus, the trough 161 and ridge 151 can be configured to serve as guides to facilitate electrically connective alignment of the first and second pads 112, 122 during engagement of the trough and ridge 161, 151.

Moving now to FIG. 14, the invention, in accordance with another embodiment thereof, can include a first alignment member 171, and can preferably include a second alignment member 172. As seen, the first and second alignment members 171, 172 can be supported on the second object 120 by way of a shaft 174. Thus, the first and second alignment members 171, 172, as well as the shaft 174 can be configured to move, or rotate, about the axis of rotation 173 as shown in FIG. 14. As also shown, a first protrusion 117, and preferably a second protrusion 118 can be supported on the first object 110. Now briefly referring to FIGS. 11, 12, and 13, it is evident that the first alignment member 171, when rotated about the axis 173, can engage the first protrusion 117. Returning now to FIG. 14, it is seen that the second alignment member 172 can be configured to engage the second protrusion 118 in a similar manner when rotated about the axis 173.

Turning to FIGS. 15 and 16, the first alignment member 171 can include a first cam surface 181, and can also include a second cam surface 182 defined thereon.

Similarly, the second alignment member 172 can also include a first cam surface 181, and can also include a second cam surface 182 in a like manner. However, as is apparent, the second alignment member 172 can preferably be a "mirror image" of the first alignment member 171.

It is evident from FIG. 14 that the first cam surfaces 181 of each of the first and second alignment members 171, 172 can be configured to contact each respective protrusion 117, 118 during engagement of the first and second alignment members therewith. It is further evident that the first cam surfaces 181 can be configured to contact each respective protrusion 117, 118 so as to cause substantial alignment of the first object 110 with the second object 120 in the lateral direction 185. It is also evident that each of the second cam surfaces 182 can be configured to contact each respective protrusion 117, 118 during engagement of the first and second alignment members 171, 172 therewith so as to cause substantial alignment of the first object 110 with the second object 120 in the fore-and-aft direction 186.

As is seen by a reference to FIGS. 13 and 14, the first and second alignment members 171, 172 can also serve to lock the first and second objects 110, 120 together when the first an second alignment mebers are engaged with the respective first and second protrusions 117, 118 as shown in FIG. 13.

Now moving to FIGS. 17 and 18, the apparatus 100 can include, in accordance with a further embodiment thereof, a shaft 174 which can be configured to rotate about an axis of rotation 173. The shaft 174 can also have a third cam surface 183 formed thereon. As further shown, the first pads 112 are supported on the first object 110. The second pads 122 are supported on the second object 120 and can be configured to be resiliently flexible and biased so as to contact the first pads 112 when the first and second objects 110, 120 are placed next to one another and when the first and second pads 112, 122 are in substantial alignment with one another.

As is further seen, the third cam surface 183 can be configured to hold the second pads 122 away from the first pads 112. However, as is evident, if the ridge 151 is matingly engaged with the trough 161, and the first pads 112 are aligned with the second pads 122, then the shaft 174 can be rotated so as to cause the third cam surface 183 to move the second pads 122 into contact with the first pads 112.

The movement of the third cam surface 183 can be made to substantially coincide with the movement of the first and second cam surfaces 181, 182, respectively, by rigidly mounting the first and second alignment members 171, 172 to the shaft 174. This can cause the first, second, and third cam surfaces 181, 182, 183 all move substantially simultaneously. Alternatively, the movement of the third cam surface 183 can be made so as to be independent of the movement of the first and second cam surfaces 181, 182. This can be accomplished by mounting the first and second alignment members 171, 172 on the shaft 174 so as to rotate independently of the shaft 174. If the shaft 174 is configured so as to independently rotate, then the third cam surface 183 can move independently with respect to the first and second cam surfaces 181, 182.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for electrically connecting two objects together, comprising:

a first object which has a ridge defined thereon and a first connective surface defined on the ridge;

a plurality of first electrical pads supported on the first connective surface;

a second object which has a trough defined thereon and a second connective surface defined within the trough;

a plurality of second electrical pads supported on the second connective surface, wherein the ridge is configured to matingly engage the trough so as to facilitate substantial juxtaposition of the first connective surface with the second connective surface; and, an alignment member which is supported on the second object and which is configured to rotate about an axis that is substantially parallel to the path of movement, and which is further configured to engage the first object when rotated, and while the ridge and trough are engaged, so as to substantially align the first electrical pads with the second electrical pads in facilitation of contact there between, and wherein:

a first cam surface is defined on the alignment member and is configured to contact the first object during movement of the alignment member so as to cause substantial alignment of the first object with respect to the second object in a lateral direction;

a second cam surface is defined on the alignment member and is configured to contact the first object during rotation of the alignment member so as to cause substantial alignment of the first object with respect to the second object in a fore-and-aft direction; and, a third cam surface is defined on the alignment member and is configured to resiliently deflect the second electrical pads during rotation of the alignment member so as to selectively cause the second electrical pads to contact the first electrical pads after engagement of the ridge and trough.

2. The apparatus of claim 1, and wherein the third cam surface is further configured to move independently with respect to the first and second cam surfaces.

* * * * *